US008763826B1

(12) United States Patent
Smith et al.

(10) Patent No.: US 8,763,826 B1
(45) Date of Patent: Jul. 1, 2014

(54) BOTTLE DESIGN AND METHOD OF MAKING AND USING THE SAME

(71) Applicants: Dale Smith, Nevada City, CA (US); Shari Chase, Zephyr Cove, CA (US)

(72) Inventors: Dale Smith, Nevada City, CA (US); Shari Chase, Zephyr Cove, CA (US)

( * ) Notice: Subject to any disclaimer, the term of this patent is extended or adjusted under 35 U.S.C. 154(b) by 0 days.

(21) Appl. No.: 13/933,089

(22) Filed: Jul. 1, 2013

Related U.S. Application Data

(60) Provisional application No. 61/666,916, filed on Jul. 1, 2012.

(51) Int. Cl.
*B65D 21/02* (2006.01)

(52) U.S. Cl.
CPC ..... *B65D 21/0234* (2013.01); *B65D 21/0233* (2013.01); *B65D 21/0231* (2013.01)
USPC ..... 215/10; 206/507; 220/4.27

(58) Field of Classification Search
CPC ..... B65D 21/0231; B65D 21/023; B65D 21/0233; B65D 21/0234; B65D 21/0235; B65D 21/0209; B65D 21/02; B65D 21/00
USPC ..... 215/10, 382; 220/675, 669, 23.83, 4.27, 220/4.26; 206/507, 505; D9/522, 744, 743
See application file for complete search history.

(56) References Cited

U.S. PATENT DOCUMENTS

| | | | | | |
|---|---|---|---|---|---|
| 2,100,035 | A | * | 11/1937 | Merrick | 211/74 |
| 3,391,824 | A | * | 7/1968 | Wiseman | 206/504 |
| 4,416,373 | A | * | 11/1983 | deLarosiere | 206/432 |
| 4,573,595 | A | * | 3/1986 | Mednis | 215/10 |
| 4,640,423 | A | * | 2/1987 | Mednis | 215/10 |
| 4,671,412 | A | * | 6/1987 | Gatten | 206/504 |
| 5,485,920 | A | * | 1/1996 | Fritz | 206/509 |
| D398,240 | S | * | 9/1998 | Willardson | D9/523 |
| D449,778 | S | * | 10/2001 | Legoupil et al. | D9/743 |
| 2002/0077225 | A1 | * | 6/2002 | Selsam | 482/93 |
| 2006/0025500 | A1 | * | 2/2006 | Rumer et al. | 523/200 |
| 2006/0255000 | A1 | * | 11/2006 | Quintana | 215/10 |

FOREIGN PATENT DOCUMENTS

| | | | | | |
|---|---|---|---|---|---|
| EP | 0007145 | A1 | * | 1/1980 | B65D 21/0235 |
| EP | 24165 | A1 | * | 2/1981 | B65D 21/02 |
| GB | 2139592 | A | * | 11/1984 | B65D 21/02 |

* cited by examiner

*Primary Examiner* — Robert J Hicks
(74) *Attorney, Agent, or Firm* — John E. Boyd

(57) ABSTRACT

A bottle or container having a shape, design or configuration that allows the bottle or container to be efficiently stacked or nestled with an identically shaped bottle rotated 180 degrees. Bundles and packages containing one or more nestled pairs of bottles according to the invention. Methods of making and using the same.

20 Claims, 10 Drawing Sheets

BOTTLE DESIGN AND METHOD OF MAKING AND USING THE SAME

RELATED APPLICATION

This application claims priority to U.S. Provisional Application No. 61/666,916, filed Jul. 1, 2012, hereby incorporated by reference.

FIELD OF THE INVENTION

The invention relates to stackable bottles and methods of making and using the same.

BACKGROUND OF THE INVENTION

Several publications are referenced in this application. The cited references describe the state of the art to which this invention pertains and are hereby incorporated by reference, particularly the products, designs, and methods set forth in the detailed description of each reference.

A variety of bottle or container designs have been used in the past for a number of applications including beverages, cleaning solutions, pourable materials/liquids, etc. Bottles and containers are typically packaged, transported and stored in bundles, cases, boxes or on skids. See, for example, the containers described in US Patent Publication 2006/0255000 to Quintana; US Patent Publication 2002/0077225 to Selsam; U.S. Pat. No. 4,671,412 to Gatten; U.S. Pat. No. 4,416,373 to deLarosiere; and U.S. Pat. No. 2,100,035, each of which are hereby incorporated by reference.

SUMMARY OF THE INVENTION

One aspect of the invention relates to a bottle or container having a shape, design or configuration that allows the bottle or container to be efficiently stacked or nestled with an identically shaped bottle rotated 180 degrees.

Advantageously, according to preferred embodiments, the bottle, when packed with an inverted nestled bottle, has a position that is stabilized by the weight and shape of the inverted nestled bottle for safer packaging, transportation and storage. Also advantageously, according to other preferred embodiments, a bundle containing one or two pairs of stacked inverted bottles require significantly less shelf or storage space compared to conventional bottles. This reduces the cost of packaging, shipping and storage. This also provides conveniences to both consumers with limited storage space and retailers with limited shelf space. Preferably, the bottle or container comprises a top, a bottom, three flat sides and a curved side that allows for the effective stacking.

Thus, unique benefit of the nesting concept is that the nesting bottles take up one-third less space on the retailer's shelves than an equal volume of standard water bottles. With retail space at a premium, this space-saving design should have broad appeal to retailers and manufacturers alike. (See comparison in FIGS. 8 and 9 of how much space six 500 ml bottles (3 liters) of water take up in comparison with an equal volume of liquid using the nesting packaging concept according to the present invention).

Another aspect of the invention relates to bundles, cases and packages comprising two or more pairs of the bottles according to the invention configured to reduce the storage space compared to conventional bottles and containers.

Another aspect of the inventions relates to methods of making and using the bottles and containers of the invention to facilitate efficient storage, transportation and use.

The foregoing has outlined some of the aspects of the present invention. These objects should be construed as being merely illustrative of some of the more prominent features and applications of the invention. Many other beneficial results can be obtained by modifying the embodiments within the scope of the invention. Accordingly other objects and a full understanding of the invention may be had by referring to this summary of the invention, the detailed description describing the preferred embodiments in addition to the scope of the invention defined by the claims taken in conjunction with the accompanying drawings. The unique features characteristic of this invention and operation will be understood more easily with the description and drawings. It is to be understood that the drawings are for illustration and description but does not define the limits of the invention.

BRIEF DESCRIPTION OF THE INVENTION

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE INVENTION

The abovementioned and other features of the invention disclosed herein are described below with reference to the drawings of the preferred embodiments. While the present description sets forth specific details of various embodiments, it will be noted that the description is illustrative only and should not be construed in any way as limiting.

Figure 1:
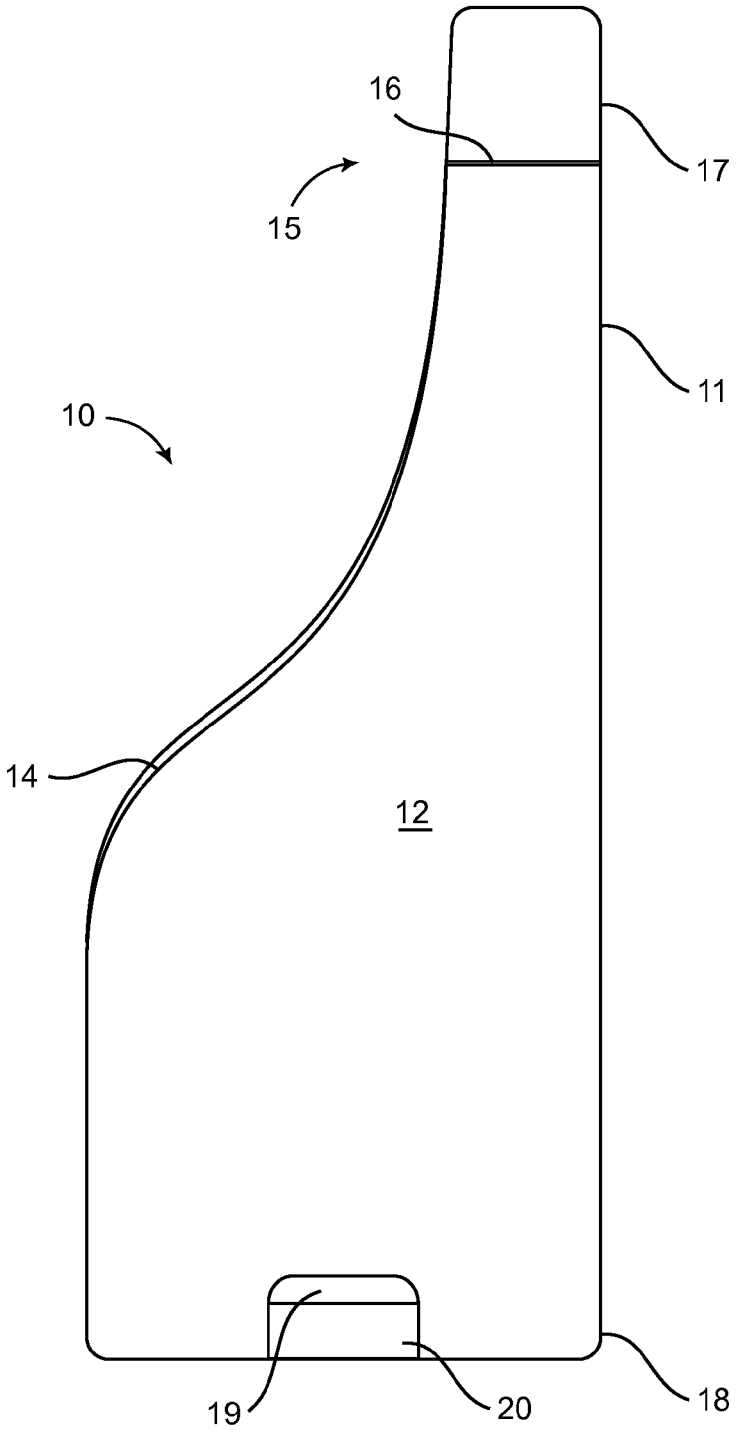
FIG. 1 is a side view of a bottle according to one embodiment of the invention.
Figure 2:
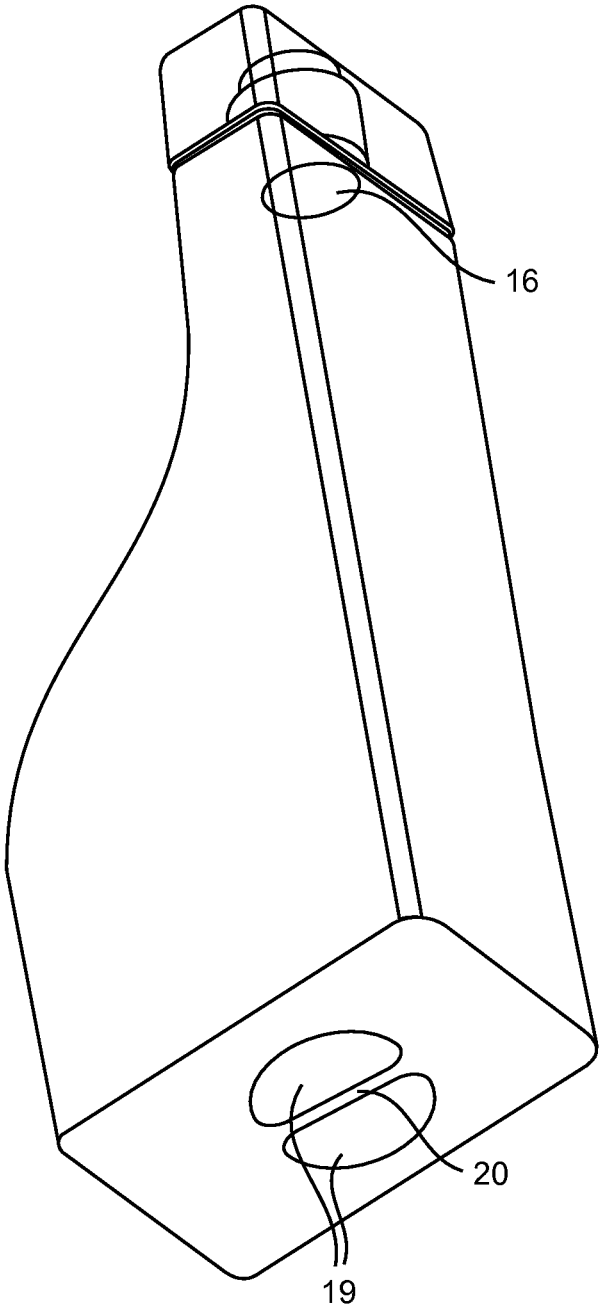
FIG. 2 is a bottom view of the bottle of FIG. 1.
Figure 3:
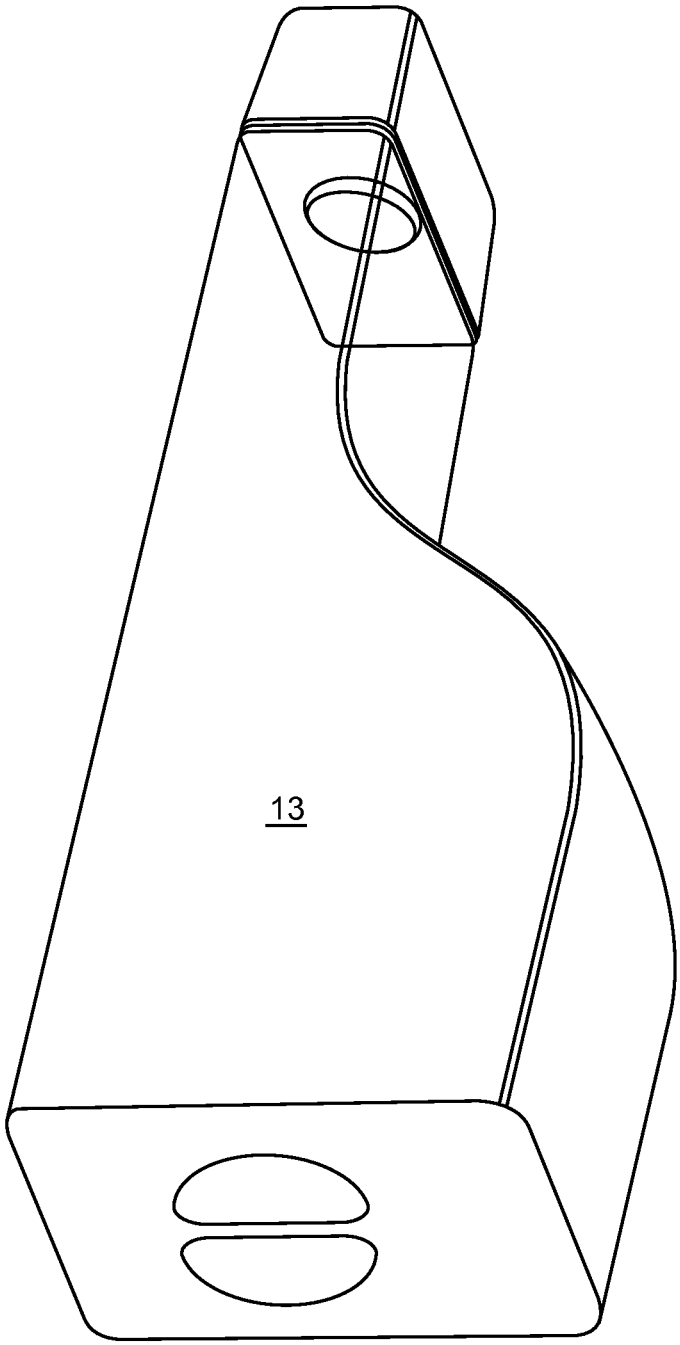
FIG. 3 is an alternate bottom view of a bottle of FIG. 1.

FIG. 1 is a side view of a bottle 10 according to one embodiment of the invention comprising a first backside 11, second side 12, third side 13 (not shown opposite side 12) and a curved side 14. Bottle 10 further comprises top 15 with closure 16 and cap 17. Bottle 10 also comprises bottom 18 comprising indentation 19 having grip 20. FIG. 2 is a bottom side view of the bottle of FIG. 1 and FIG. 3 is an alternate bottom side view of FIG. 1.

The invention product can be a bottle, container, canister, tank, box, carton or other product for containing fluids, gases, or materials. References to "bottle" or "container" herein shall not be limiting.

Accordingly, one aspect of the invention relates to unique bottle or container designs that provide for more efficient packing, storage and transporting, as well as enhanced stability. Specifically, the product is designed to allow for pairs of bottles or containers to be efficiently nestled when packed or stored by allowing one inverted container or bottle to be stacked directed onto another container or bottle to result in a bundle having a cuboid shape with little or no void space between the stacked bottles.

One embodiment of the invention relates to a stackable bottle comprising one curved side and three flat sides. Preferably, the curved side has a curve resulting in the bottle being narrow at the top and wider at the bottom. Preferably, the shape of the bottle allows it be packaged or bundled efficiently with another identical inverted bottle. Preferably, the pair of bottles or containers is similar to two pieces of a puzzle whereby the curved sides match resulting in a cuboid when the pieces are nestled together.

Another embodiment of the invention relates to a stackable, interlocking bottle comprising a top, a bottom, one curved side and three flat sides. Referring to FIG. 1, the invention is preferably configured to be nestled with an upside-down identical bottle.

Preferably, the bottle has a chair-shape, "pregnant-shape" or h-shape cross-sectional shape with a narrow top and wider bottom. The curved side that "interlocks" or "fits" with the inverted bottle when forming a bundle pair is designed or configured to provide greater stability when stacked and more efficient packing and storage.

Another embodiment of the invention relates to a bottle comprising:

(a) a top, (b) a flat bottom, (c) three flat sides; and (d) a curved side, wherein the curved side has a shape forming a widest bottle dimension at the flat bottom in a first direction perpendicular to the curved side and a narrowest bottle dimension at the top in the first direction, and further provided that the shape is configured such that when such bottle is (i) nestled with an identically shaped bottle which is rotated 180 degrees about the first direction of the bottle and (ii) the flat bottom of the bottle aligned with the top of the rotated identically shaped bottle, the resulting nestled bottles comprise less than five volume percent void space between the bottle and the identically shaped bottle, preferably less than 4 volume percent, more preferably less than 3 volume percent, even more preferably less 2 volume percent, even more preferably less 1 volume percent, and most preferred less than 0.5 volume percent.

Figure 4:
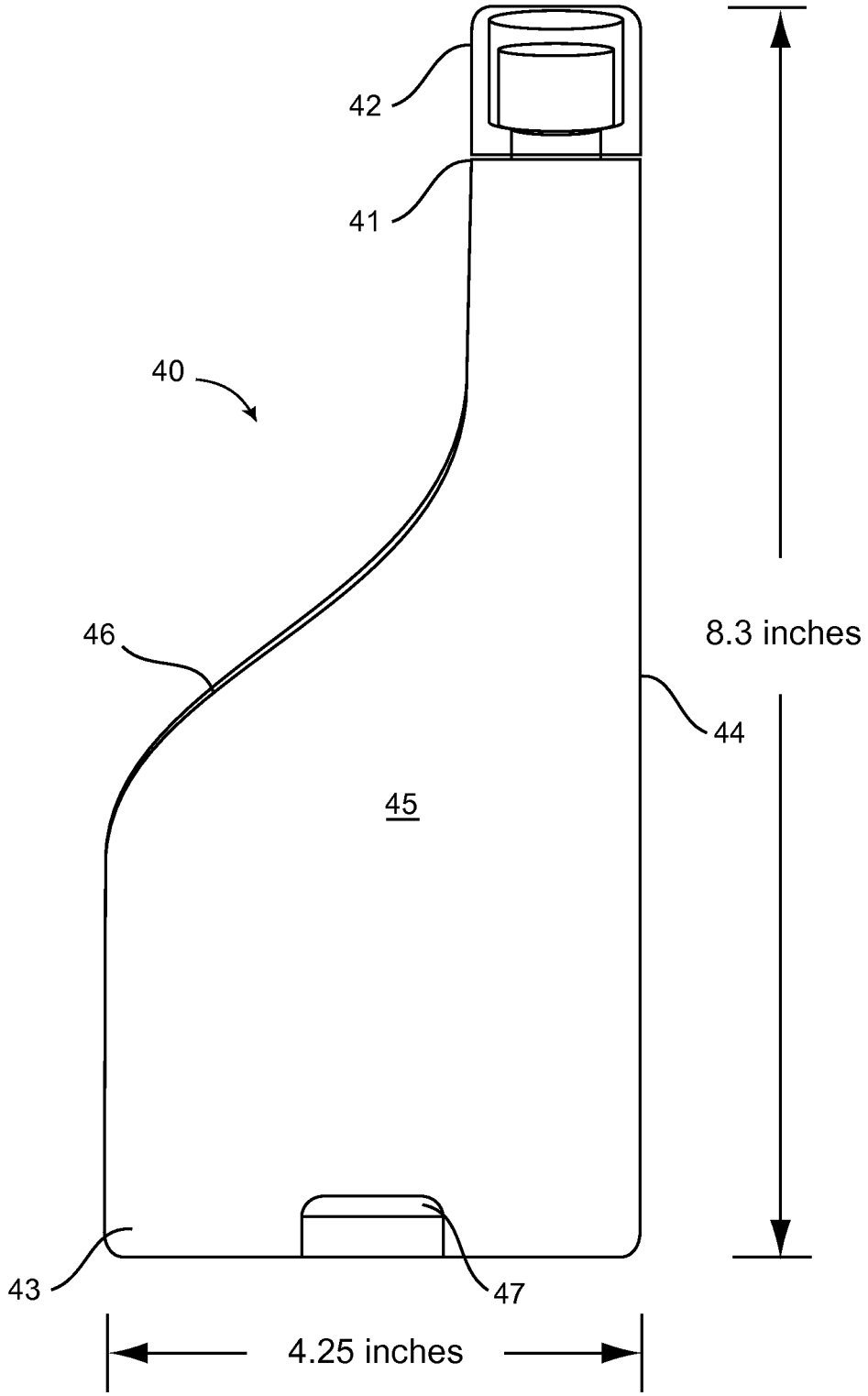
FIG. 4 is a side view of a bottle according to another embodiment of the invention.
Figure 5:
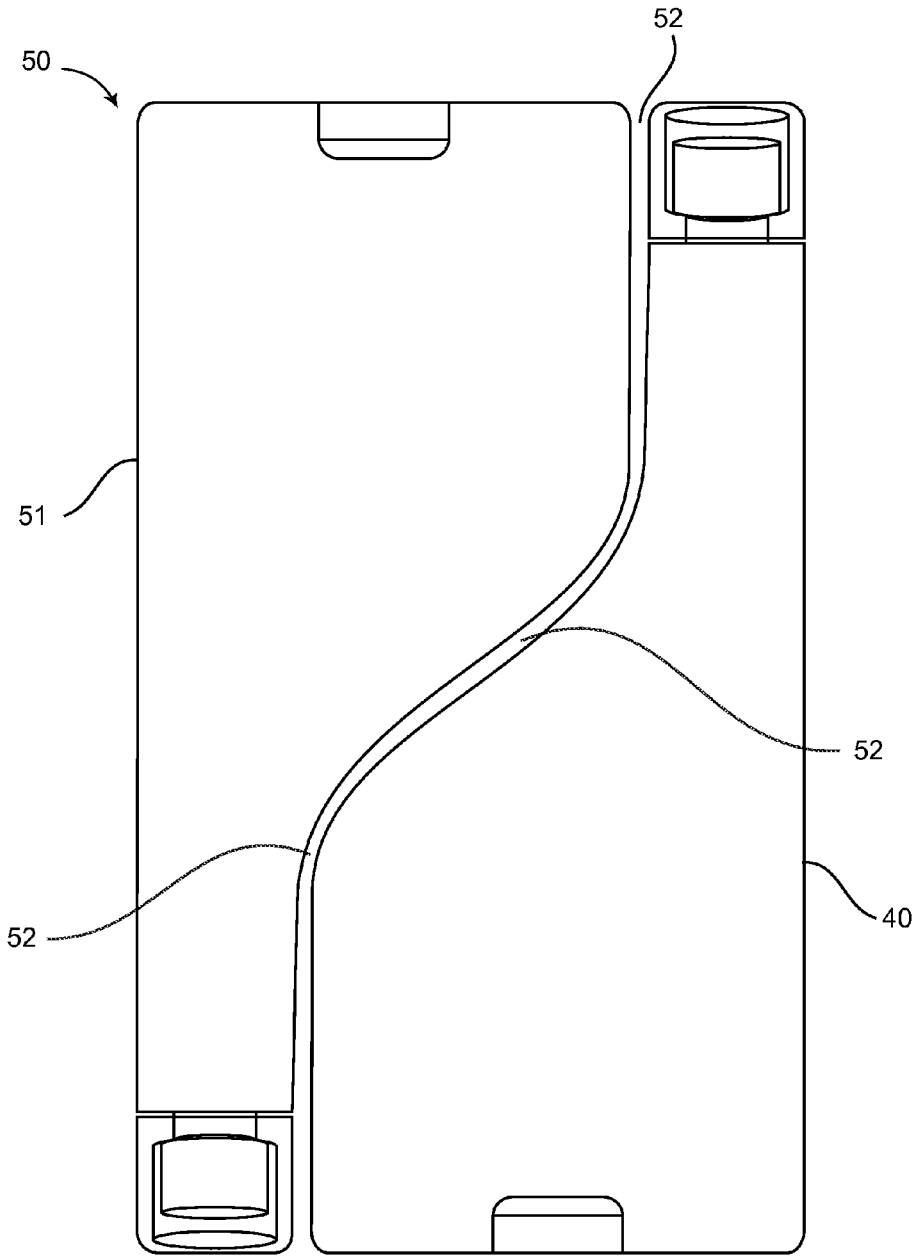
FIG. 5 is a side view of a pair of "nestled" bottles according to another aspect of the invention.

FIG. 4 depicts a 750 ml bottle 40 according to the invention having a top 41 with cap 42, bottom 43, flat backside 44, two flat sides 45 and curved side 46 and grip indentation 47. FIG. 5 shows a bundle 50 including the bottle 40 of FIG. 4 nestled with identically shaped bottle 51. As can be seen, the gap or void space 52 between bottles 40 and 51 can be minimized by using a curvature on the curved side 46 that allows the bottles to be nestled efficiently.

According to preferred embodiments, the top is flat.

Preferably, the bottle further comprises a removable cap attached to the top.

Preferably, the bottle further comprises a cap with a closure hidden beneath.

Preferably, the bottle further comprises an opening for filling and discharging the bottle.

Preferably, the bottle top comprises a 1-inch diameter opening. Alternative embodiments can include an opening between ⅞ inches and 1⅛ inches or other ranges suitable for use in the invention.

According to preferred embodiments, the closure device is engineered as such so that when the closure cap is affixed (sealed to the bottle) it ends up flush with the flat sides. Preferably, each side surface of the affixed cap is flush with a side of the bottle. Preferably, the cap has a cuboid shape. Preferably, each exterior side of the cap is flat.

According to preferred embodiments, the bottom of the bottle is flat. Alternatively, the bottom is slightly curved. Preferably, the flat bottom comprises a sculpted (preferably finger-friendly) indentation to allow for easy extraction or lifting of the bottle. Preferably, the flat bottom comprises a sculpted, finger-friendly indentation for easy extraction. Preferably, the flat bottom comprises an indentation to allow for easy extraction or lifting.

Preferably, the bottle further comprises a recess in the bottom with a grip or handle adapted to allow the bottle to be easily extracted with thumb and forefinger from a bundle or package when the bottle or container is inverted upside down.

Preferably, the widest bottle dimension of the bottle is between 1 inch and 5 inches and the bottle has a height between 2 inches and 10 inches. According to preferred embodiments, the widest bottle dimension is between 4 and 5 inches and the bottle has a height between 8 and 10 inches. Alternatively, the dimensions of the bottle or container can range depending on the use and application.

Preferably, the three sides of the bottle are flat.

According to other preferred embodiments, the three sides have slightly curved edges.

Preferably, the curved side comprises a concave portion and a convex portion.

Preferably, the curved side comprises a concave portion adjacent the top and a convex portion adjacent the flat bottom.

Another aspect of the invention relates to bundles, cases, packages or boxes containing two or more nestled bottles according to the invention.

According to one embodiment, the nestled bottles from a rectangular or square cuboid. Preferably, the curved side comprises a symmetrically curved edge that divides the cuboid shape into equal shapes.

For example, to assist in demonstrating the benefits and advantages of the invention, for a 3 liter or any other proportional sized template: the flat two-dimensional side (rectangle) measures 4¾" wide by 8¼" tall. Beginning approximately 1" from the top left edge and extending downward is a symmetrical curved line that serves to divide the shape into two halves of equal dimension and proportion. Or, referring to the right bottle 41 in FIG. 4, curve 42 starts approximately 1 inch from top right curving down to terminate 1 inch right 45 from lower left 46.

According to preferred embodiments, the dimensions are 4¾"×4¾"×8¼" cuboid, which will result in a total volume of 3 liters comprised of 4-750 ml bottles.

According to preferred embodiments, the bottle, when packed with an inverted nestled bottle, has a position that is stabilized by the weight and shape of the inverted nestled bottle. Referring to FIG. 4, for example, the top bottle on the left holds down and secures the bottom bottle on right. The ability to more tightly pack bottles and containers in an interlocking manner according to the invention results in less shifting, misalignment, vibrations and other packaging, storage and transportation issues.

Preferably, when the bottle is packed with other three identical bottles, the bottles can be packaged to form a rectangular cuboid bundle. Preferably, the rectangular cuboid bundle has six flat sides formed by the four nestled bottles.

Preferably, when the bottle is a 750 ml bottle and is used in a 4-bottle bundle comprised of four identical nestled 750 ml bottles, the bundle comprises at least 10 percent less footprint (or shelve space), preferably 15% less, more preferably 20% less, even more preferably 25% less, even more preferably 30% less, and most preferred 33% less than an equal total volume standard bundle of six 500 ml conventional bottles. This ability to package, store and/or transport liquids and other materials with ⅓ less space provides valuable advantages. Shop owner's benefit from being able to display more items with limited shelf space. Shippers can ship more in the same trucks. Homeowners can store greater amounts of products. Manufacturers can package the bottles or containers using less packaging materials. According to preferred embodiments, the invention provides improved storage economies and efficiencies to both consumers and retailers.

Preferably, the bottles individual are unsymmetrical, while the bundle or package created by nestling two bottles is a cuboid shape (a symmetrical six-sided cube), whether the combined bundle is 2 liters, 3 liters, 4 liters or any size. For example, a cuboid measuring 4¾ inches by 4¾ inches×8¼" inches yields approximately 3 liters. For the purpose of this invention, the term "cuboid" is defined as a solid figure bounded by six faces in which each of the faces is a rectangle or square and each pair of adjacent faces meets in a right angle (e.g., a cube-like structure).

Accordingly, preferably, the bottle has an asymmetric shape about a vertical axis passing centrally through the bottle centrally through the top. Preferably, bottle has an asymmetric shape about a vertical axis passing centrally through the bottom. For example, a typical water bottle has symmetry looking down on the bottle, with the inventive bottle there's asymmetry since one side is a substantially flat back, while the other side is curved. That is, when looking down on a conventional bottle, one sees a circle, while looking down on the bottle of the invention there is a square or rectangle. As another comparison, if one starts at the center of a conventional bottle and looks outwardly one sees the same dimension in each direction, while not so with the bottle of the invention since the view in one direction is towards a curved side, while the other view is towards a substantially flat back.

Preferably, the bottle is configured to stand upright and stable when on a horizontal surface.

Moreover, according to preferred embodiments, the bottle or container has substantially flat sides so when laid on its side, it doesn't roll providing a more stable container.

Preferably, the bottle comprises plastic or glass.

According to preferred embodiments, the bottle is made using compostable materials. Preferably, made using Ingeo (a corn-based plastic that is (ultimately) compostable). Preferably, the entire container is made from a compostable material, more preferably also the cap, even more preferably, also the packaging.

According to preferred embodiments, the top is sealed using a string and sealing wax. Preferably, the string and sealing wax are applied to maintain a substantially flat top. Preferably, the string closure is decorative to appeal to certain target markets.

According to another preferred embodiment, the cap (under which the opening to the bottle is hidden) is a rectangular cuboid shape that allows more leverage when opening the bottle. Conventional small water bottles, because of their small cap size, are often difficult to open.

Another aspect of the invention relates to bundles or packages containing two or more containers according to the invention for more efficient packing, storage and transportation.

One embodiment of the invention relates to a bundle of bottles comprising four bottles, wherein each bottle comprises:

(a) a top, (b) a bottom, (c) three flat sides; and (d) a curved side, wherein the curved side has a shape forming a widest bottle dimension in a first direction perpendicular to the curved side at the flat bottom and a narrowest bottle dimension in the first direction at the top, and wherein the bundle of four bottles form a rectangular cuboid and comprises less than one volume percent void space between the bottles.

Preferably, the bundle further provides that when each bottle is nestled with an identically shaped bottle which is rotated 180 degrees about the first direction of the bottle the resulting nestled bottles comprise less than one percent volume void space between the bottle and the identically shaped bottle.

Another embodiment of the invention relates to a bundle of bottles comprising four nestled bottles, wherein two bottles are right-side up and two inverted 180-degrees upside down and wherein the bundle has a rectangular cuboid shape and each bottle has one curved side nestled against the curved side of another bottle.

Preferably, the bundle of bottles comprises less that five percent by volume void space between the bottles, preferably less than 4 volume percent, more preferably less than 3 volume percent, even more preferably less 2 volume percent, even more preferably less 1 volume percent, and most preferred less than 0.5 volume percent.

Preferably, the curved side has a surface that completely contacts the surface of the curved side of the other bottle.

Preferably the bundle further comprises a binding surrounding the bundle to bind the bottles together.

Preferably, the binding is a sheath of plastic shrink-wrap film.

Figure 6:
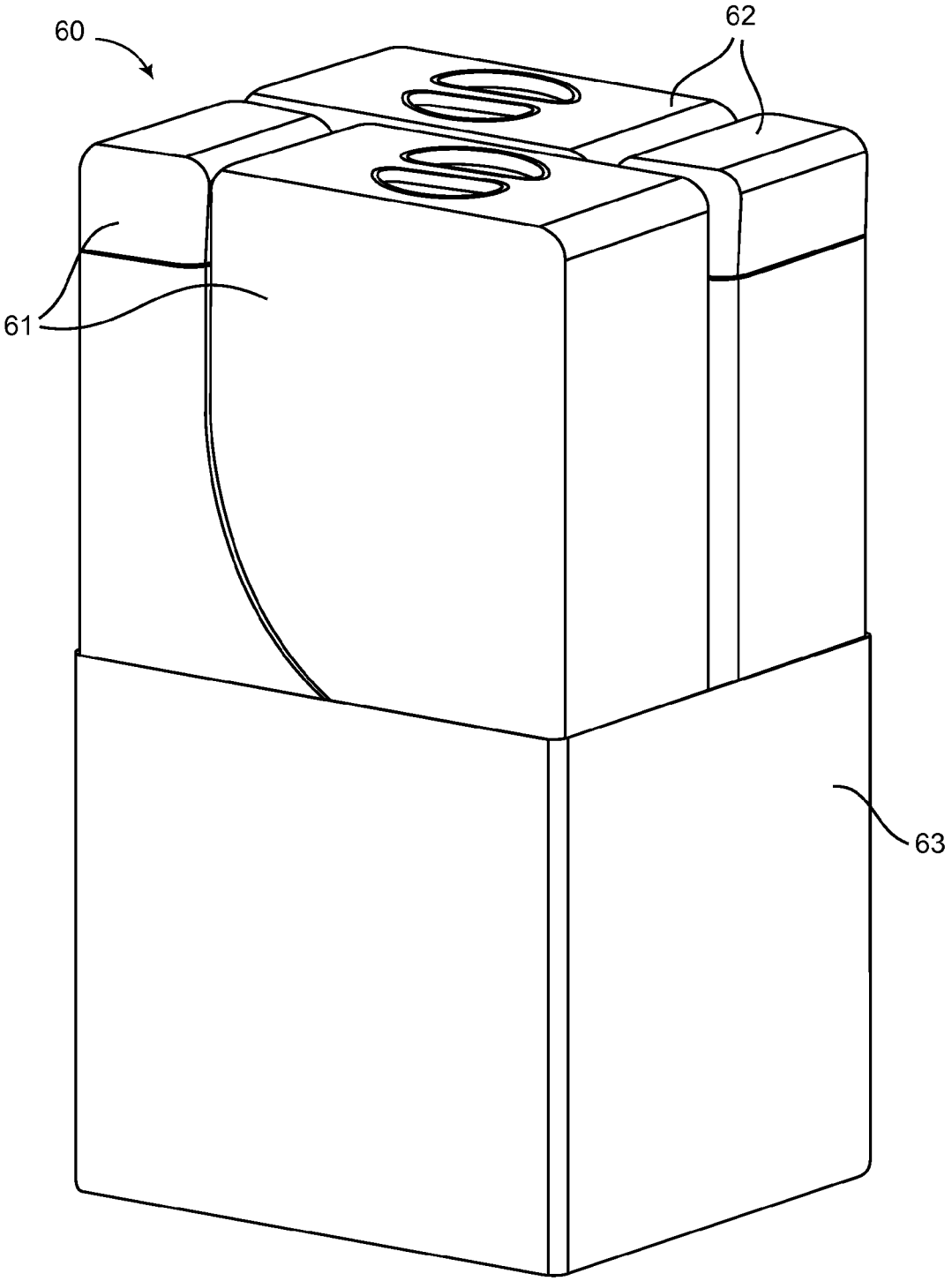
FIG. 6 is a four-bottle bundle including two pairs of "nestled" bottles according to another aspect of the invention.

FIG. 6 shows bundle 60 comprising a first pair 61 and second pair 62 of paired inverted containers according to a preferred embodiment of the invention. Referring to FIG. 6, the four bottles are tightly nestled to form an efficient package 63 with reduce void space between the individual containers. According to preferred embodiments, the resultant bundle is cuboid allowing multiple bundles to be easily stacked, packaged and/or transported. The resultant bundle according to the invention provides enhanced stability as a result of the nestled configuration increasing safety and convenience, while reducing the amount (including strength, thickness, weight, size, etc.) of the packaging material used to form the bundle. For example, referring to bundle 60 shown in FIG. 6, a single half box 63 can secure four containers yet have a reduce shelf footprint as a result of the efficient stacking of the containers. Preferably, the footprint of the four-bottle or four-container package is at least 10% less, preferably 15% less, more preferably 25% less, even more preferably 33% less and most preferably at least 50% less compared to containers that are not nestled or stacked according to the invention.

The 'nesting' concept is designed to offer liquid products such as water, beverages ketchup, mustard, shampoo and conditioners, olive and cooking oil, motor oil, or any other liquids that could be sold in units of four to increase sales and provide more efficient packing, storage and/or transportation and also increased stability. In addition to liquids, the containers or bottles may contain flowable or pourable products such as rice, spices, grains, beads, shampoo, olive oil, pellets, soil, fuel, gaseous compositions, fertilizer, or any material or product that can be poured or can flow from a container or bottle.

Figure 7:
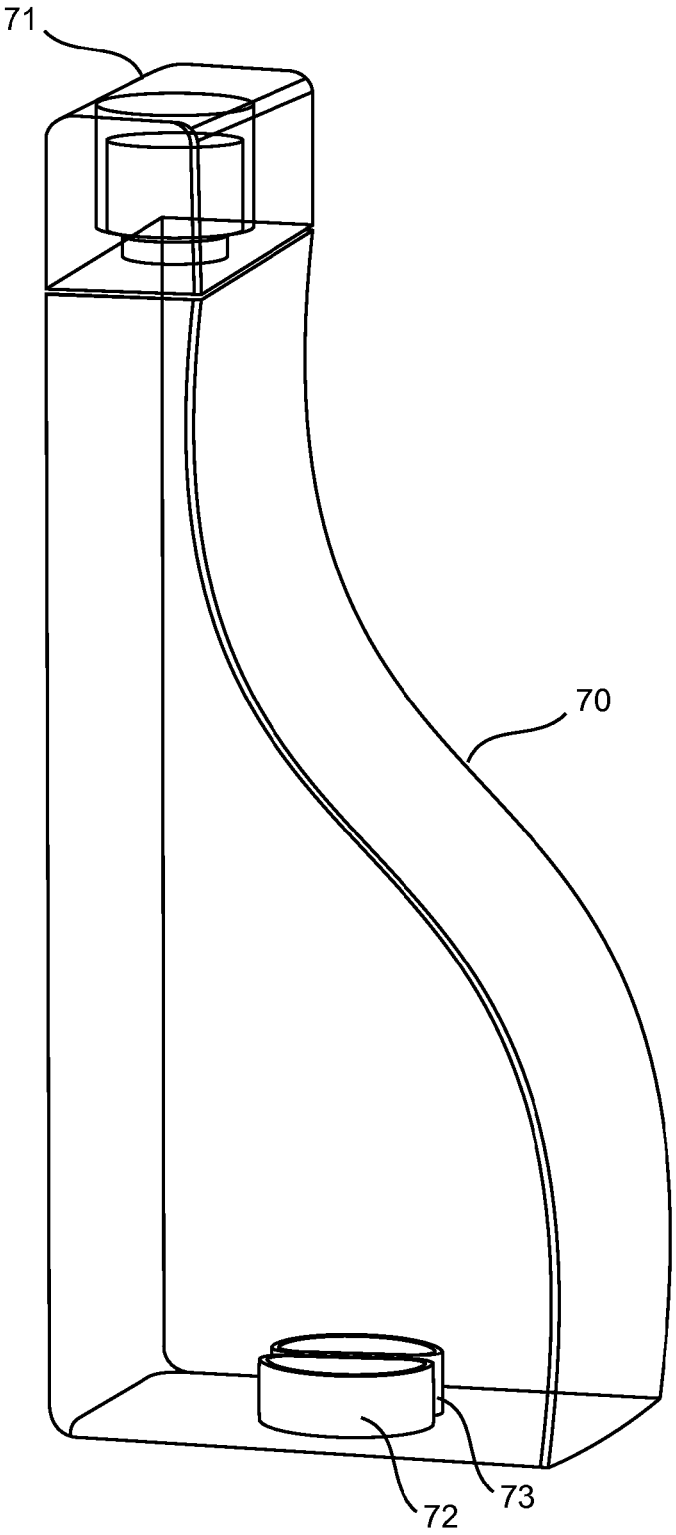
FIG. 7 is a side view of a bottle according to another embodiment of the invention.

FIG. 7 shows a container 70 according to another embodiment of the invention including cap 71 and bottom indentation 72 with finger grip 73.

Another embodiment relates to a bottle comprising one curved side and three flat sides, wherein the curved side has a shape forming a widest bottle dimension in a first direction perpendicular to the curved side at the flat bottom and a narrowest bottle dimension in the first direction at the top.

Another embodiment relates to a bottle comprising one curved side and three flat sides, wherein the curved side has a shape forming a widest bottle dimension in a first direction perpendicular to the curved side at the flat bottom and a narrowest bottle dimension in the first direction at the top and further provided that when such bottle is (i) nestled with an identically shaped bottle which is rotated 180 degrees about the first direction of the bottle and (ii) the flat bottom of the bottle aligned with the top of the rotated identically shaped bottle, the resulting nestled bottles comprise less than one volume percent void space between the bottle and the identically shaped bottle Another embodiment relates to a bottle having a shape characterized by dividing a rectangular cuboid into two equal halves with a curved cut resulting in two of the bottles each having a flat top, a flat bottom, three flat sides and an identically shaped curved side.

Another embodiment relates to a bottle comprising one curved side and three flat sides and further provided that the curved side is configured such that when such bottle is (i) nestled with an identical bottle which is rotated 180 degrees about a first direction perpendicular to the curved side and (ii) the nestled bottles are aligned by height top to bottom, the resulting nestled bottles comprise less than one volume percent void space between the bottle and the identically shaped bottle.

According to one preferred embodiment, the design or configuration can be defined by starting with a cuboid measuring 4.5 inches×4.5 inches×8.3 inches. The cuboid may be of different dimensions, depending on the volume of the bottles needed for the final product, but the concept and the shape of the resulting bottles remains the same. This shape represents 3.05 liters in volume. The cuboid is then divided into two equal halves with a curve shaped cut. The remaining side is then divided in half with a straight vertical cut. The result is four equal shapes, each containing approximately 750 ml of volume. A cuboid of two liters would produce 4-500 ml bottles; a one-liter cuboid would produce 4-250 ml bottles. The unique form and design of the bottles help to support each other within their package when packaged together according to the invention.

Figure 8:
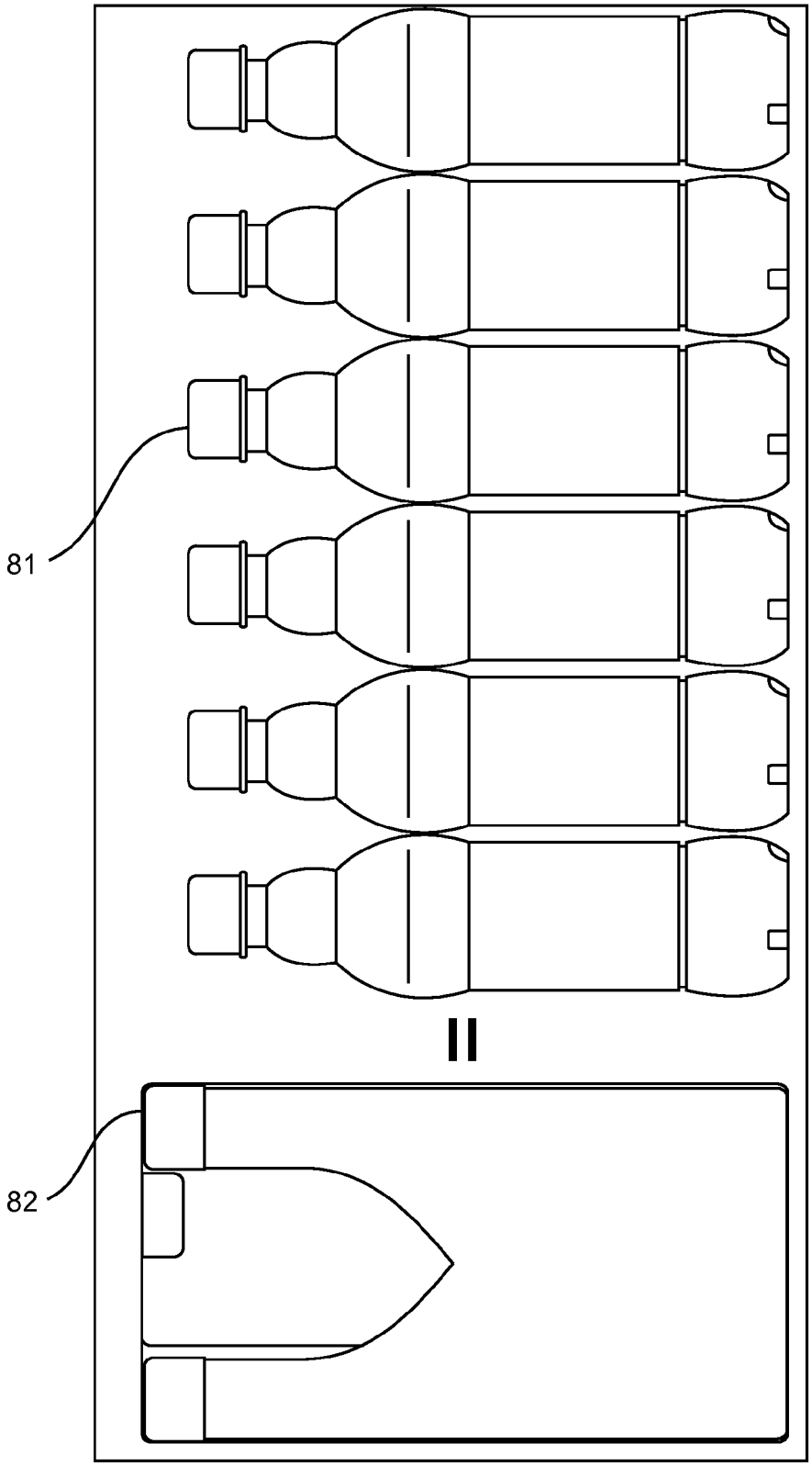
FIG. 8 is a side view comparison of a four-bottle bundle according to the invention compared with six conventional bottles having the same combined volume.
Figure 9:
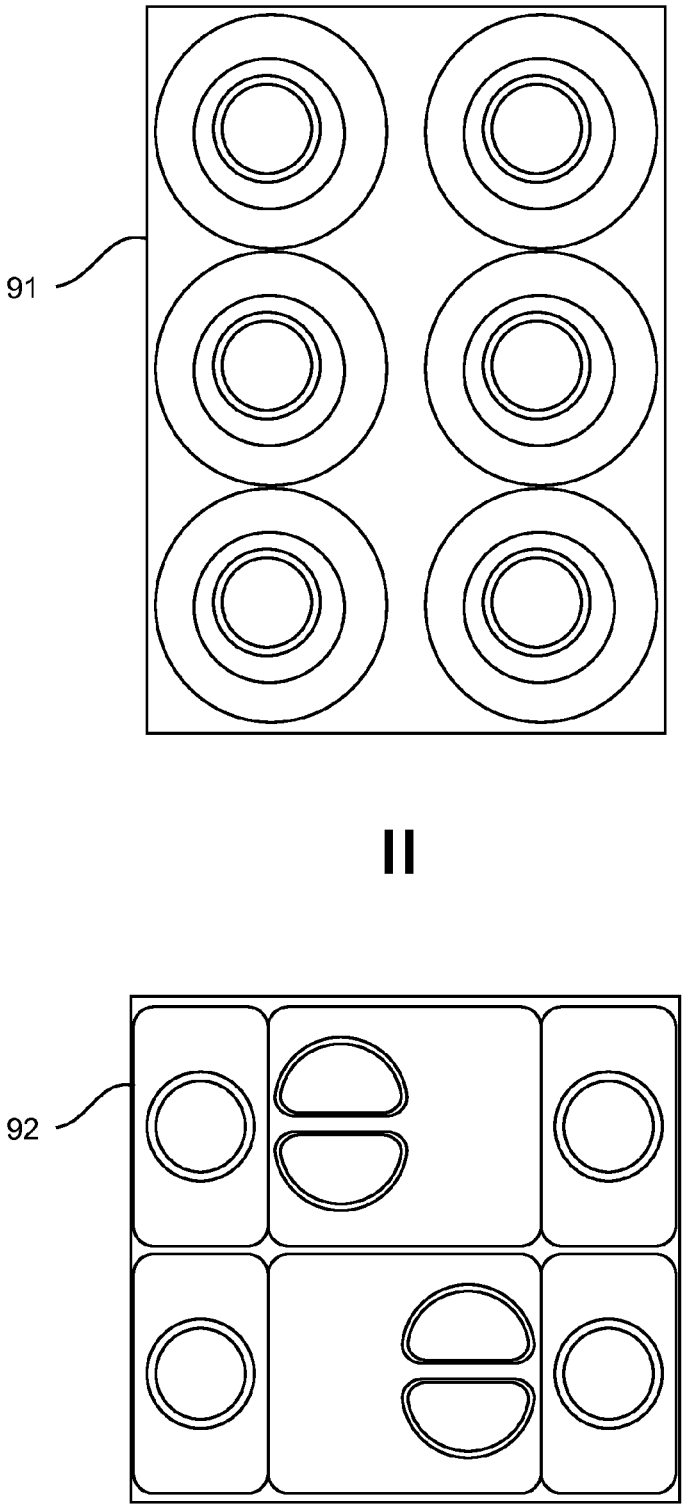
FIG. 9 is a top view comparison of a four-bottle bundle according to the invention compared with a bundle of six conventional bottles having the same collective volume.

One unique benefit of the nesting concept according to preferred embodiments of the invention is that the nesting bottles take up one-third less space on the retailer's shelves than an equal volume of standard water bottles. With retail space at a premium, this space-saving design should have broad appeal to retailers and manufacturers alike. FIG. 8 shows a comparative illustration (side view) of the amount of space six 500 ml bottles (3 liters) of water 81 take up in comparison with an equal volume of liquid using the nesting packaging concept products 82. FIG. 9 shows a comparative illustration (top view) of the amount of space a 2×3 bundle of six 500 ml bottles (3 liters) of water 91 take up in comparison with an equal volume of liquid using a four container nesting packaging product 92 according to the invention.

Figure 10:
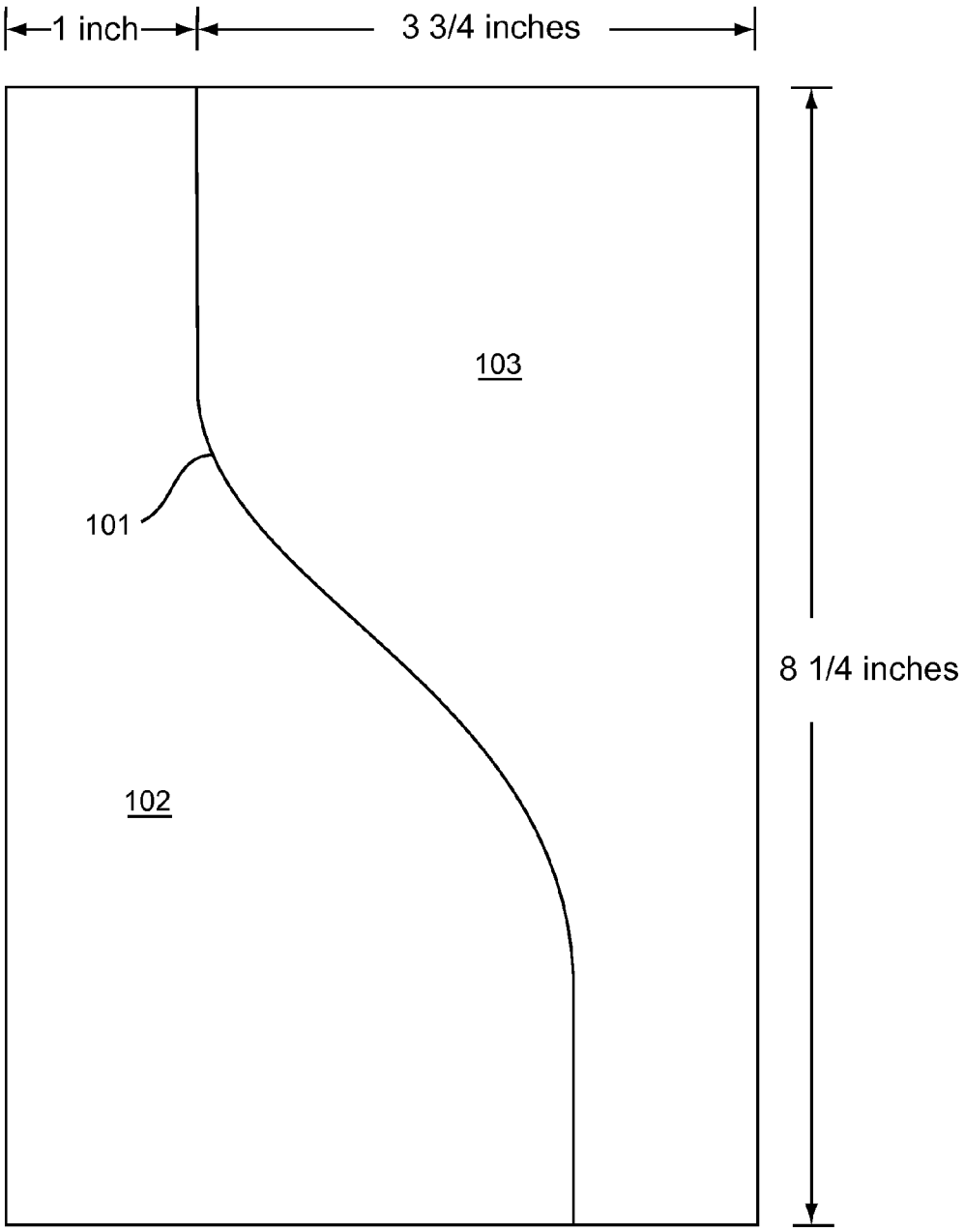
FIG. 10 is a side schematic drawing of a bottle according to another embodiment of the invention.

FIG. 10 is a graphical representation of a curved side 101 according to one embodiment of the invention forming a left bottle 102 and inverted right bottle 103.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

With respect to the appended claims, unless stated otherwise, the term "first" does not, by itself, require that there also be a "second". While the particular compositions, formulations, products and methods described herein and described in detail are fully capable of attaining the above-described objects and advantages of the invention, it is to be understood that these are the presently preferred embodiments of the invention and are thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular means "one or more" and not "one and only one", unless otherwise so recited in the claim.

It will be appreciated that modifications and variations of the invention are covered by the above teachings and within the purview of the appended claims without departing from the spirit and intended scope of the invention.

The invention claimed is:

1. A bottle comprising:

(a) a top, (b) a flat bottom, (c) three flat sides; and (d) a curved side, wherein said curved side has a shape forming a widest bottle dimension at the flat bottom in a first direction perpendicular to said curved side and a narrowest bottle dimension at said top in said first direction, and further provided that said shape is configured such that when such bottle is (i) nestled with an identically shaped bottle which is rotated 180 degrees about said first direction of said bottle and (ii) said flat bottom of said bottle aligned with the top of said rotated identically shaped bottle, the resulting nestled bottles comprise less than one volume percent void space between said bottle and said identically shaped bottle.

2. The bottle of claim 1, wherein said top is flat.

3. The bottle of claim 1, further comprising a removable cap attached to said top.

4. The bottle of claim 1, further comprising a cap with a closure hidden beneath.

5. The bottle of claim 1, wherein said top comprises an opening for filling and discharging said bottle.

6. The bottle of claim 1, wherein said flat bottom comprises an indentation to allow for easy extraction or lifting of the bottle.

7. The bottle of claim 1, wherein said curved side profile starts at said flat bottom contining to said top without reversing direction at any point along said curve side.

8. The bottle of claim 1, wherein said three flat sides have curved edges.

9. The bottle of claim 1, wherein said curved side comprises a concave portion adjacent said top and a convex portion adjacent said flat bottom.

10. The bottle of claim 1, wherein said bottle, when packed with an inverted nestled bottle, has a position that is stabilized by the weight and shape of said inverted nestled bottle.

11. The bottle of claim 10, wherein said nestled bottles from a rectangular or square cuboid.

12. The bottle of claim 1, wherein said bottle, when packed with three other identical bottles, said bottles can be packaged to form a rectangular cuboid bundle.

13. The bottle of claim 12, wherein said rectangular cuboid bundle has six flat sides formed by said four nestled bottles.

14. The bottle of claim 1, wherein when said bottle is a 750 ml bottle and is used in a 4-bottle bundle comprised of four identical nestled 750 ml bottles, said bundle comprises at least 33 percent less footprint than an equal total volume bundle of six 500 ml conventional water bottles.

15. The bottle of claim 1, wherein said bottle has an asymmetric shape about a vertical axis passing centrally through said bottle.

16. The bottle of claim 1, wherein said bottle is configured to stand upright and stable when on a horizontal surface.

17. A bottle comprising a flat bottom, a top, one curved side and three flat sides, wherein said curved side has a shape forming a widest bottle dimension in a first direction perpendicular to said curved side at the flat bottom and a narrowest bottle dimension in said first direction at said top and wherein said bottle is configured to be packed with another identical inverted bottle resulting in a cuboid comprised of both bottles and having less than 2% void space between the nestled bottles.

18. A bottle comprising a flat bottom, a top, one curved side and three flat sides, wherein said curved side has a shape forming a widest bottle dimension in a first direction perpendicular to said curved side at the flat bottom and a narrowest bottle dimension in said first direction at said top and further provided that when such bottle is (i) nestled with an identically shaped bottle which is rotated 180 degrees about said first direction of said bottle and (ii) said flat bottom of said bottle aligned with the top of said rotated identically shaped bottle, the resulting nestled bottles comprise less than one volume percent void space between said bottle and said identically shaped bottle.

19. A bottle having a shape characterized by dividing a rectangular cuboid into two equal halves with a curved cut resulting in two of said bottles each having a flat top, a flat bottom, three flat sides and an identically shaped curved side and said rectangular cuboid having less than 1% void space between the nestled bottles.

20. The bottle of claim 1, wherein said bottle has an h-shaped cross-sectional shape.

* * * * *